US008926126B2

(12) United States Patent
Ronen et al.

(10) Patent No.: US 8,926,126 B2
(45) Date of Patent: Jan. 6, 2015

(54) ADJUSTABLE, MODULAR LIGHTING FIXTURE

(75) Inventors: Yaron Ronen, Jerusalem (IL); Brian Hillstrom, Loretto, MN (US); Stephen Lynn Rogers, North Salt Lake, UT (US)

(73) Assignee: 3form, LLC, Salt Lake City, UT (US)

( * ) Notice: Subject to any disclaimer, the term of this patent is extended or adjusted under 35 U.S.C. 154(b) by 40 days.

(21) Appl. No.: 13/447,681

(22) Filed: Apr. 16, 2012

(65) Prior Publication Data

US 2013/0271977 A1 Oct. 17, 2013

(51) Int. Cl.
*F21V 19/02* (2006.01)
*F21V 17/02* (2006.01)
*F21V 19/00* (2006.01)

(52) U.S. Cl.
USPC ..... 362/239; 362/249.1; 362/249.01; 362/236; 362/225

(58) Field of Classification Search
USPC ..... 362/235, 239, 125–126, 249.07–249.1, 362/217.01–217.17, 225
See application file for complete search history.

(56) References Cited

U.S. PATENT DOCUMENTS

| | | | | |
|---|---|---|---|---|
| 7,572,028 | B2 * | 8/2009 | Mueller et al. | 362/227 |
| 2008/0304252 | A1 * | 12/2008 | Shibusawa et al. | 362/125 |
| 2009/0040782 | A1 * | 2/2009 | Liu et al. | 362/555 |
| 2010/0271804 | A1 * | 10/2010 | Levine | 362/35 |
| 2010/0284181 | A1 * | 11/2010 | O'Brien et al. | 362/235 |
| 2010/0295468 | A1 * | 11/2010 | Pedersen et al. | 315/294 |
| 2011/0051401 | A1 * | 3/2011 | Bauer et al. | 362/125 |
| 2011/0051407 | A1 * | 3/2011 | St. Ives et al. | 362/225 |
| 2011/0128737 | A1 * | 6/2011 | Kim | 362/249.03 |
| 2011/0141722 | A1 * | 6/2011 | Acampora et al. | 362/218 |
| 2011/0310604 | A1 * | 12/2011 | Shimizu et al. | 362/235 |

FOREIGN PATENT DOCUMENTS

DE 4310760 A1 * 12/1993

* cited by examiner

*Primary Examiner* — Mariceli Santiago
(74) *Attorney, Agent, or Firm* — Workman Nydegger

(57) ABSTRACT

Implementations of the present invention relate to a rotatable and/or slidable lighting module. The lighting module can have a lighting fixture assembly that is optionally capable of rotating with respect to a support base to allow the lighting fixture assembly to project light on a desired surface or area. The lighting fixture assembly can also slide or move relative to the support base to allow the position of the lighting fixture to be selectively varied.

18 Claims, 7 Drawing Sheets

ADJUSTABLE, MODULAR LIGHTING FIXTURE

CROSS-REFERENCE TO RELATED APPLICATIONS

N/A.

BACKGROUND OF THE INVENTION

1. The Field of the Invention

This invention relates to systems, methods, and apparatus for background and general lighting.

2. Background and Relevant Art

Lights and light fixtures can find frequent use in various architectural structures. For example, light fixtures can provide general illumination of an area or an object to make the same visible to observers. Additionally or alternatively, light fixtures can provide background lighting to illuminate signs and messages.

Lighting fixtures also can provide illumination for various types of light boxes that can display signs or advertising. Conventional light boxes include a box-like housing secured to a wall or other support structure. A light source, such as a light fixture, is mounted within the housing and illuminates the display from behind. Such back-lit displays often include a translucent plastic sheet upon which advertising or notices are written. By back lighting the display, the light box increases the notice-ability and aesthetic appeal of the display.

In addition to using light boxes to display advertising or informational signs, designers and architects have begun using light boxes to display decorative architectural panels. In particular, designers and architects will sometimes add to the functional and/or aesthetic characteristics of a given structure by mounting or displaying decorative architectural panels within a light box. For example, decorative architectural panels provide designers and architects with a virtually endless array of options in terms of improving or otherwise changing the internal or external aesthetics of the structure. Specifically, the designer or manufacturer can modify the color and texture of a given structure simply by modifying such features in the panels secured to the given structure. Mounting such decorative resin panels within light boxes can increase the appeal of the panel by magnifying the color, transparency, and other aesthetic features of the panel.

Conventional light fixtures, whether installed independently or within a light box, often require an installer or installer to precisely mark mounting locations of the light fixture within the light box. Typically, the installer may have to provisionally position each the light fixture within the light box and mark mounting locations of the light fixture. The installer may then remove the light fixture and prepare the mounting locations (e.g., drill/tap holes for mounting screws). Then the installer may once again position the light fixture in the light box and secure the light fixture at the mounting locations. Such installation process can result in suboptimal time allocation due to numerous steps required during the installation as well as due to human error.

Accordingly, there are a number of disadvantages in lighting components and light boxes that can be addressed.

BRIEF SUMMARY OF THE INVENTION

Implementations of the present invention solve one or more of the foregoing or other problems in the art with systems, methods, and apparatus for lighting or backlighting an object such as a light box. One or more implementations provide a lighting module having a modular and variably adjustable construction. In particular, the lighting module can include a support base and a lighting fixture assembly secured to the support base. The lighting fixture assembly can rotate and/or translate relative to the support base. Furthermore, the modular construction of the lighting modules can allow for the tailoring of the modules to fit any number of different sized or configured projects.

For example, one implementation includes a lighting module that has at least one support base and a lighting fixture assembly. The support base is configured to be secured to a support surface. The lighting fixture assembly includes a body having a length, and one or more element assemblies. The lighting fixture assembly is movably securable to the at least one support base such that once secured to the at least one support base, the lighting fixture assembly can be selectively translated relative to the at least one support base.

Another implementation includes a lighting system. The lighting system includes a first lighting fixture assembly having a first end, an opposing second end, and a first plurality of lighting elements positioned between the first and second ends. Each lighting element of the first plurality of lighting elements is spaced a first distance from adjacent lighting elements of the first plurality of lighting elements. Additionally, the lighting element of the first plurality of lighting elements closest to the first end is spaced one half of the first distance from the first end of the first lighting fixture assembly. Similarly, the lighting element of the first plurality of lighting elements closest to the second end is spaced one half of the first distance from the second end of the first lighting fixture assembly. The lighting system further includes a first support base configured to be secured to a support surface. The first lighting fixture assembly is rotatably and movably securable to the first support base such that once secured to the first support base, the first lighting fixture assembly can be selectively translated and rotated relative to the first support base.

In addition to the foregoing, another implementation includes a uniformly illuminated light box with sliding lighting modules. The light box includes a frame, one or more translucent panels secured to the frame, and one or more lighting modules. Each lighting module of the one or more lighting modules has a support base secured to the frame and a lighting fixture assembly. The lighting fixture assembly is slidably coupled to the support base, such that the lighting fixture assembly can be selectively positioned relative to the support base and to the one or more translucent panels.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. For better understanding, the like elements have been designated by like reference numbers throughout the various accompanying figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
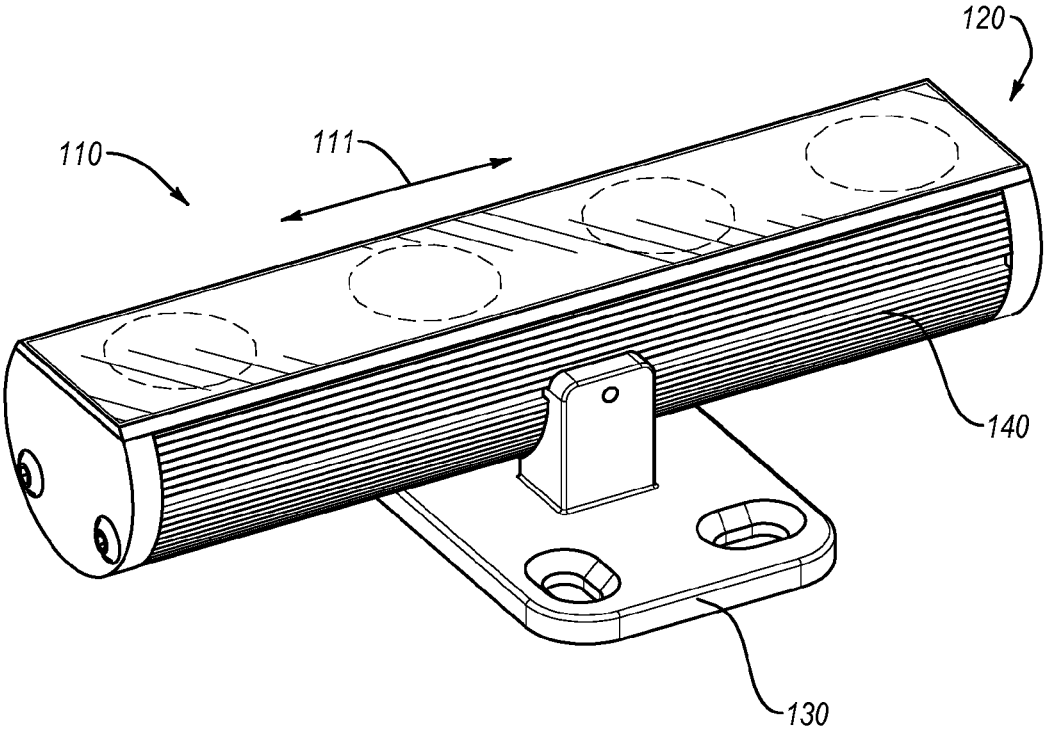
FIG. 1 illustrates a perspective view of a lighting module in accordance with one or more implementations of the present invention.

Implementations of the present invention provide systems, methods, and apparatus for lighting or backlighting an object such as a light box. One or more implementations provide a lighting module having a modular and variably adjustable construction. In particular, the lighting module can include a support base and a lighting fixture assembly secured to the support base. The lighting fixture assembly can rotate and/or translate relative to the support base. Furthermore, the modular construction of the lighting modules can allow for the tailoring of the modules to fit any number of different sized or configured projects.

Accordingly, lighting modules of one or more implementations can provide a versatile lighting system that can facilitate background and general lighting. Furthermore, the lighting modules can reduce installation time, while improving the quality and precision of an installed system. For instance, in at least one implementation, the lighting module can include a lighting fixture assembly and a base support. The lighting fixture assembly can both rotate and slide or translate relative to the base support. In particular, the support base can allow the lighting fixture assembly to be positioned at any number of positions relative to a support surface. Hence, an installer can slide and/or rotate the lighting fixture assembly precisely to a desired position.

The ability to slidably position the lighting fixture assembly can reduce assembly and installation time of the lighting module(s). For instance, the installer can secure the support base in generally desired location on a support surface. The installer can then secure the lighting fixture assembly to the support base. In at least one implementation, the lighting fixture assembly can snap onto the support base. Once secured to the support base, the assembly can adjust the location of the lighting fixture assembly without removing, repositioning, and re-securing the support base. In addition to reducing the time spent on assembly and installation, the installer can achieve a more precise position of the lighting elements and of the light projected therefrom.

At least one implementation can include a multi-module lighting system that has multiple lighting modules cooperating to project light onto one or more surfaces or areas. Such implementations can have a first module and a second module linearly aligned in the longitudinal direction. Furthermore, the installer can independently position the first module and the second module, with respect to one another as well as with respect to the surface or area that a user desires to illuminate. Thus, the installer can save additional time when installing multiple lighting modules, since the installer can easily and quickly position each module to project light onto the desired location and at a desired angle.

One or more implementations can also include a uniformly illuminated light box. Such implementations can include a frame, one or more translucent panels, and one or more lighting modules. The lighting modules can have the features and functionally described above. Thus, the installer generally can secure one or more support bases within the frame. Subsequently, the installer can couple one or more lighting fixture assemblies to the secured support bases. Because the installer can slide and/or rotate the light fixture assemblies with respect to the secured support base(s), the installer can position the light fixture modules to achieve a desired light distribution within the light box. Additionally, in at least one implementation, the desired light distribution within the box can uniformly illuminate one or more translucent panels.

Figure 2:
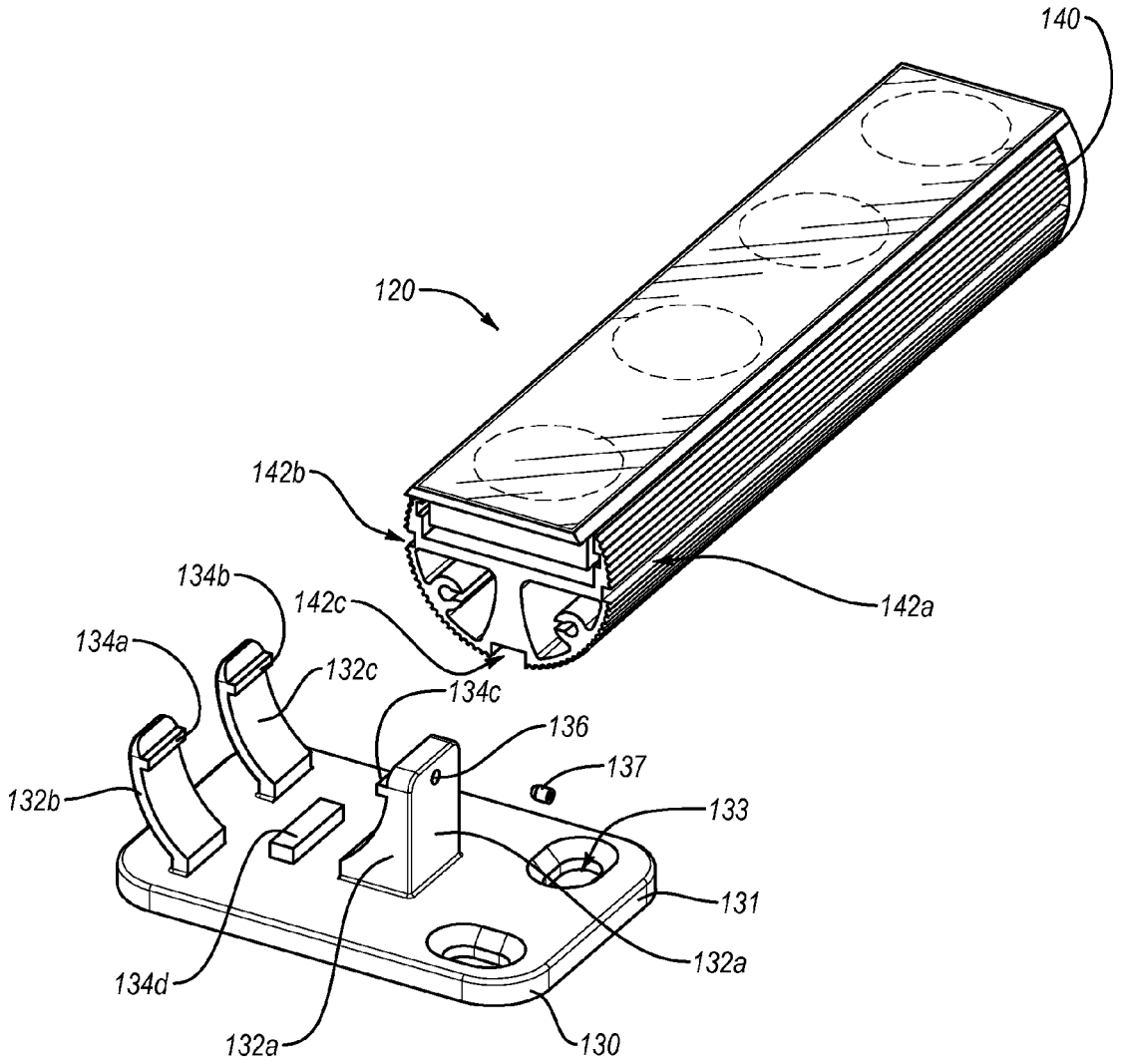
FIG. 2 illustrates a partial exploded perspective view of the lighting module of FIG. 1.

As described above, in at least one implementation, one or more lighting modules can provide a versatile lighting installation or a lighting system. For example, FIGS. 1 and 2 illustrates a perspective view and a partial exploded view of a lighting module 110. As shown, the lighting module 110 can include a lighting fixture assembly 120 coupled to a support base 130. The lighting fixture assembly 120 can include one or more lighting elements configured to produce light as explained in greater detail below. The support base 130 can adjustably couple the lighting fixture assembly 120 to a support surface.

For example, the lighting fixture assembly 120 can slide or translate relative to the support base along a longitudinal axis (or a length) thereof as indicted by arrow 111 of FIG. 1. Accordingly, the lighting module 110 can accommodate installation by, for example, allowing the installer to first secure the support base 130 to a support surface. Subsequently, the assembly can couple the lighting fixture assembly 120 to the support base 130. The support base 130 can allow the installer to adjust the position of the lighting fixture assembly 120 with respect to the support base 130 after coupling the lighting fixture assembly 120 to the support base 130.

The lighting fixture assembly 120 can include a body 140. The body 140 can couple to the support base 130 and support the features of the lighting fixture assembly 120. In one or more implementations, the body 140 comprises a heat sink. In particular, the body 140 can include fins 143 that provide increased surface area to allow for the dissipation of heat.

More specifically, referring now to FIG. 2, the base support 130 can include a base plate 131 and one or more rails 132*a*, 132*b*, 132*c*. The base plate 131 can include one or more mounting holes 133. The mounting holes 133 can have a size and a configuration adapted to receive one or more fasteners (e.g., screw, wire, nail, anchor) for securing the support base 130 to a support structure. As shown in FIGS. 1 and 2, in one or more implementations the mounting holes 133 are located to the side of the rails 132*a*, 132*b*, 132*c* so as to be associable when the lighting fixture assembly 120 is secured to the base support 130. In alternative implementations, the mounting holes 133 can be located between the rails 132*a*, 132*b*, 132*c* so that the mounting holes 132 are concealed when the lighting fixture assembly 120 is secured to the base support 130. One will appreciate that positioning the mounting holes 133 between the rails 132*a*, 132*b*, 132*c* can allow for a base plate 131 with a smaller footprint or size.

The rails 132*a*, 132*b*, 132*c* can couple the lighting fixture assembly 120 to the base support 130 and allow for adjustability of the lighting fixture assembly 120. In particular, the rails 132*a*, 132*b*, 132*c* can extend generally longitudinally away from the base plate 131. In one or more implementations, the rails 132*a*, 132*b*, 132*c* can comprise a curvature corresponding to the outer curvature of the lighting fixture assembly 120.

In one or more implementations the rails 132*a*, 132*b*, 132*c* can be flexible so as to be able to flex outward. The ability to flex can allow the rails 132*a*, 132*b*, 132*c* to flex outward to receive the lighting fixture assembly 120 and then return inward to hold the lighting fixture assembly 120. In other words, the rails 132*a*, 132*b*, 132*c* can allow the lighting fixture assembly 120 to be snapped therein. Thus, an installer can secure the support base 130 to a support structure and then snap the lighting fixture assembly 120 to the support base 130 without having to use additional fasteners.

The support base 130 can further include one or more slide protrusions 134*a*, 134*b*, 134*c*, 134*d*. The slide protrusions 134*a*, 134*b*, 134*c*, 134*d* can extend generally inward from the rails 132*a*, 132*b*, 132*c* and/or the base plate 131. The slide protrusions 134*a*, 134*b*, 134*c*, 134*d* can have a size and a shape corresponding to one or more features on the lighting fixture assembly 120.

In particular, the body 140 of the lighting fixture assembly 120 can include one or more mounting grooves 142*a*, 142*b*, 142*c* that extend along the length of the body 140. The mounting grooves 142*a*, 142*b*, 142*c* can allow the lighting fixture assembly 120 to couple to and slide or translate relative to the support base 130, while remaining coupled to the support base 130. The slide protrusions 134*a*, 134*b*, 134*c*, 134*d* can mate with the mounting grooves 142*a*, 142*b*, 142*c*.

Specifically, the rails 132*a*, 132*b*, 132*c* can flex outward allowing the slide protrusions 134*a*, 134*b*, 134*c* to enter and mate with the mounting grooves 142*a*, 142*b*, 142*c*. The rails 132*a*, 132*b*, 132*c* can then return due to their resiliency return inward thereby locking the slide protrusions 134*a*, 134*b*, 134*c* in the mounting grooves 142*a*, 142*b*, 142*c*.

In addition to securing the body 140 to the support base 130, the slide protrusions 134*a*, 134*b*, 134*c*, 134*d* and the mounting grooves 142*a*, 142*b*, 142*c* can allow the lighting fixture assembly 120 to translate or slide relative to the support base 130. In particular, an installer can push the lighting fixture assembly 120 relative to the support base 130 causing the slide protrusions 134*a*, 134*b*, 134*c*, 134*d* to slide or move along the mounting grooves 142*a*, 142*b*, 142*c*. The ability to adjust the position of the lighting fixture assembly 120 relative to the support base 130 without removing or otherwise adjust fasteners attaching the support base 130 to the support surface can provide a number or advantages.

For instance, the installer can secure the support base 130 in a generally desired location on a support surface. The installer can then secure the lighting fixture assembly 120 to the support base 120. In particular, the installer can push the body 140 of the lighting fixture assembly 120 against the rails 132*a-c*, thereby causing the rails 132*a-c* to flex outward. The installer can then advance the lighting fixture assembly 120 toward the support base 120 until the slide protrusions 134*a*, 134*b*, 134*c*, 134*d* snap into the mounting grooves 142*a*, 142*b*, 142*c*. Once secured to the support base, the installer can adjust the location of the lighting fixture assembly 120 without removing, repositioning, and re-securing the support base 130. In addition to reducing the time spent on assembly and installation by not requiring exact placement of the support base 130, the ability to slide the lighting fixture assembly 120 can allow for easy adjustments.

As shown in FIG. 2, in one or more implementations, the mounting grooves mounting grooves 142*a*, 142*b*, 142*c* can comprise slots extending into the body 140. The mounting grooves 142*a*, 142*b*, 142*c* can extend along the entire length of the body 140 as shown in FIG. 2. In alternative implementations, the mounting grooves 142*a*, 142*b*, 142*c* can extend along only a portion of the length of the body 142. One will appreciate in light of the disclosure herein that the length of the mounting grooves 142*a*, 142*b*, 142*c* can dictate the range of adjustability of the lighting fixture assembly 120 relative to the support base 130.

The mounting grooves mounting grooves 142*a*, 142*b*, 142*c* can have a rectangular dovetail, circular, or other cross-sectional shape. In any event, the mounting grooves mounting grooves 142*a*, 142*b*, 142*c* can have a size and shape so as to be able to receive the slide protrusions 134*a-d*. Along similar lines, the slide protrusions 134*a-d* can have a rectangular shape as shown by FIG. 2. In alternative implementations, the slide protrusions 134*a-d* can include an enlarged distal end (end furthest from the respective rail 132*a-c*. The head of the slide protrusions 134*a-d* can deform to enter the slide protrusions 134*a-d* and then exert pressure on the slide protrusions 134*a-d* to secure them within the slide protrusions 134*a-d*.

FIG. 2 illustrates that the body 140 includes three mounting grooves 142*a*, 142*b*, 142*c* equally spaced about the bottom of the body 140. In particular, FIG. 2 illustrates side mounting grooves 142*a*, 142*b* located on the sides of the body 140, and a bottom mounting groove 142*c* located on the bottom of the body 140 opposite the lighting elements. In alternative implementations, the body 140 can include less than three mounting grooves 142*a*, 142*b*, 142*c* (i.e., one or two mounting grooves 142*a*, 142*b*, 142*c*). In still further implementations, the body 140 can include more than three mounting grooves 142*a*, 142*b*, 142*c*.

As described above, the lighting fixture assembly 120 can slidably couple to support base 130 such that the installer can slide the lighting fixture assembly 120 along its longitudinal axis relative to the support base 130 and the support surface. Additionally, the support base 130 and/or corresponding portions of the lighting fixture assembly 120 can impede or prevent the lighting fixture assembly 120 from unwanted or accidental lateral movement.

In other words, the lighting module 110 can include one or more locking mechanisms to selectively lock the longitudinal position of the lighting fixture assembly relative to the support base 130. For instance, one or more of the rails 13*a* can include a through-hole 136. An installer can secure a fastener, such as a set screw 137, within the through-hole 136 until it abuts against the body 140 and prevents longitudinal movement of the lighting fixture assembly 120 relative to the support base 130. Alternatively or additionally, friction between the slide protrusions 134*a-d* and the mounting channels 142*a-c* can impede or prevent unwanted and/or unintentional sliding or translational movement of the lighting fixture assembly 120 relative to the support base 130.

Figure 3:
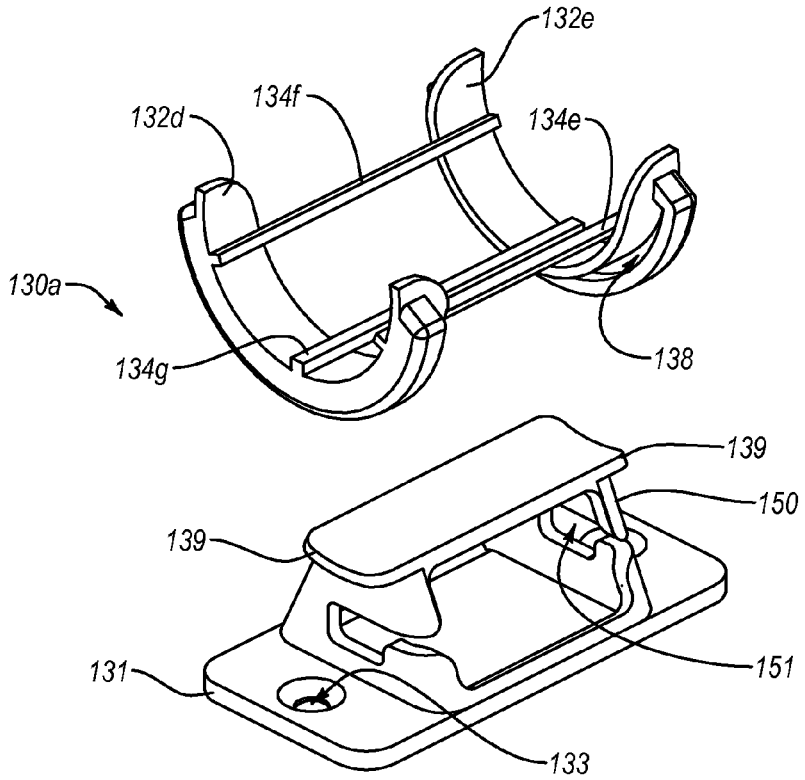
FIG. 3 illustrates a view of another implementations of a base support for a lighting module in accordance with one or more implementations of the present invention.

As mentioned previously, in one or more implementations the support base 130 can allow the lighting fixture assembly 120 to rotate in addition to translating relative to the support structure. For example, FIG. 3 illustrates another implementation of a support base 130*a* that allows for rotation of the lighting fixture assembly 120. Similar to the support base 130, the support base 130*a* can include a base plate 131, mounting holes 133, rails 132*d*, 132*e*, and slide protrusions 134*e*, 134*f*, 134*g*.

The rails 132*d*, 132*e*, can couple the lighting fixture assembly 120 to the base support 130*a* and allow for adjustability of the lighting fixture assembly 120. In one or more implementations the rails 132*d*, 132*e*, are flexible so as to be able to flex outward. The ability to flex can allow the rails 132*d*, 132*e*, to flex outward to receive the lighting fixture assembly 120 and then return inward to hold the lighting fixture assembly 120. In other words, the rails 132*d*, 132*e*, can allow the lighting fixture assembly 120 to be snapped therein. Thus, an installer can secure the support base 130*a* to a support structure and then snap the lighting fixture assembly 120 to the support base 130*a* without having to use additional fasteners.

The support base 130*a* can further include one or more slide protrusions 134*e*, 134*f*, 134*g*. The slide protrusions 134*e*, 134*f*, 134*g* can extend generally inward from the rails 132*d*, 132*e*. The slide protrusions 134*e*, 134*f*, 134*g* can have a size and a shape corresponding to the mounting grooves protrusions 134*e*, 134*f*, 134*g* of the lighting fixture assembly 120. Thus, as explained above, the mounting grooves 142*a*, 142*b*, 142*c* can allow the lighting fixture assembly 120 to couple to and slide or translate relative to the support base 130*a*, while remaining coupled to the support base 130*a*. Thus, secured to the support base 130*a*, the installer can adjust the location of the lighting fixture assembly 120 without removing, repositioning, and re-securing the support base 130*a*.

The rails 132*d*, 132*e* of the support base 130*a* can be rotationally coupled to the base plate 131. In particular, each of the rails 132*d*, 132*e* can include a slide channel 138. The slide channels 138 can comprise L-shaped channels extending from the rails 132*d*, 132*e*. The slide channels 138 can include a semi-circular or other curvature.

The slide channels 138 can house tabs 139 extending from the base plate 131. The tabs 139 can comprise protrusions that extend laterally so as to be able to fit within the slide channels 138. In particular, the tabs 139 can extend from a mount 150 extending from the base plate 131. The mount 150 can further include a cable slot 151 for holding a cable 183 (see FIG. 5) therein. In any event, when the tabs 139 are positioned within the slide channels 139, a user can rotate the rails 132*d*, 132*e* (and a lighting fixture assembly 120 coupled thereto) by sliding the rails 132*e*, 132*e* relative to the tabs 139.

Additionally or alternatively, the installer can secure and prevent the lighting fixture assembly 120 from unwanted rotation with an aid of or more fasteners. For example, one or more of the rails 132*d*, 132*e* can include a through-hole 136 (see FIG. 2). An installer can secure a fastener, such as a set screw 137 (see FIG. 2), within the through-hole 136 until it abuts against a tab 139 and prevents rotational movement of the rails 132*d*, 132*e* and the lighting fixture assembly 120 relative to the support base 130*a*. Alternatively or additionally, friction between the slide channels 138 can impede or prevent unwanted and/or unintentional sliding or translational movement of the tabs 139 therein.

Figure 4:
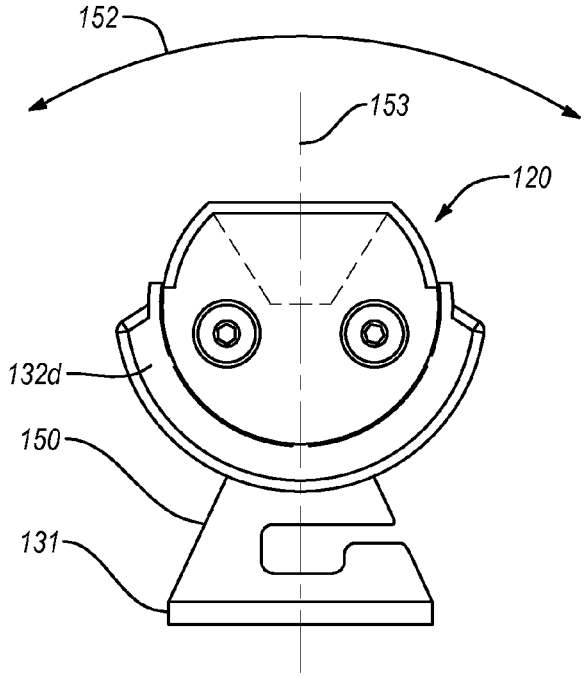
FIG. 4 illustrates a side view of a lighting module including the base support of FIG. 3 in accordance with one or more implementations of the present invention.

FIG. 4 illustrates an end view of a lighting fixture module 120 secured to a support base 130*a*. As illustrated in FIG. 4, the lighting fixture assembly 120 can rotate approximately 220° with respect to the base plate 131. In particular, FIG. 4 illustrates the lighting fixture module 120 aligned with an axis 153 extending perpendicularly from the base plate 131. The rails 132*d*, 132*e* can allow an installer to rotate the lighting fixture assembly 120 either clockwise or counter-clock wise approximately 110° relative to the axis 153. As the lighting fixture assembly 120 rotates, the light emitted by the various lighting elements can illuminate a desired surface or area.

Thus, an installer can position the lighting fixture assembly 120 in any number of different positions with respect to the support base 130, 130*a* by sliding and/or rotating the lighting fixture assembly 120 relative to the support base 130, 130*a*. Furthermore, the installer can adjust, reposition, or fine tune the position of the lighting fixture assembly 120 without having to adjust the position of the base plate 131. In one or more implementations, the installer can adjust the position of the lighting fixture assembly 120 without having to loosen, tighten, or remove any fasteners or other hardware. Thus, the lighting fixture module 110 can provide great flexibility and variability.

Figure 5:
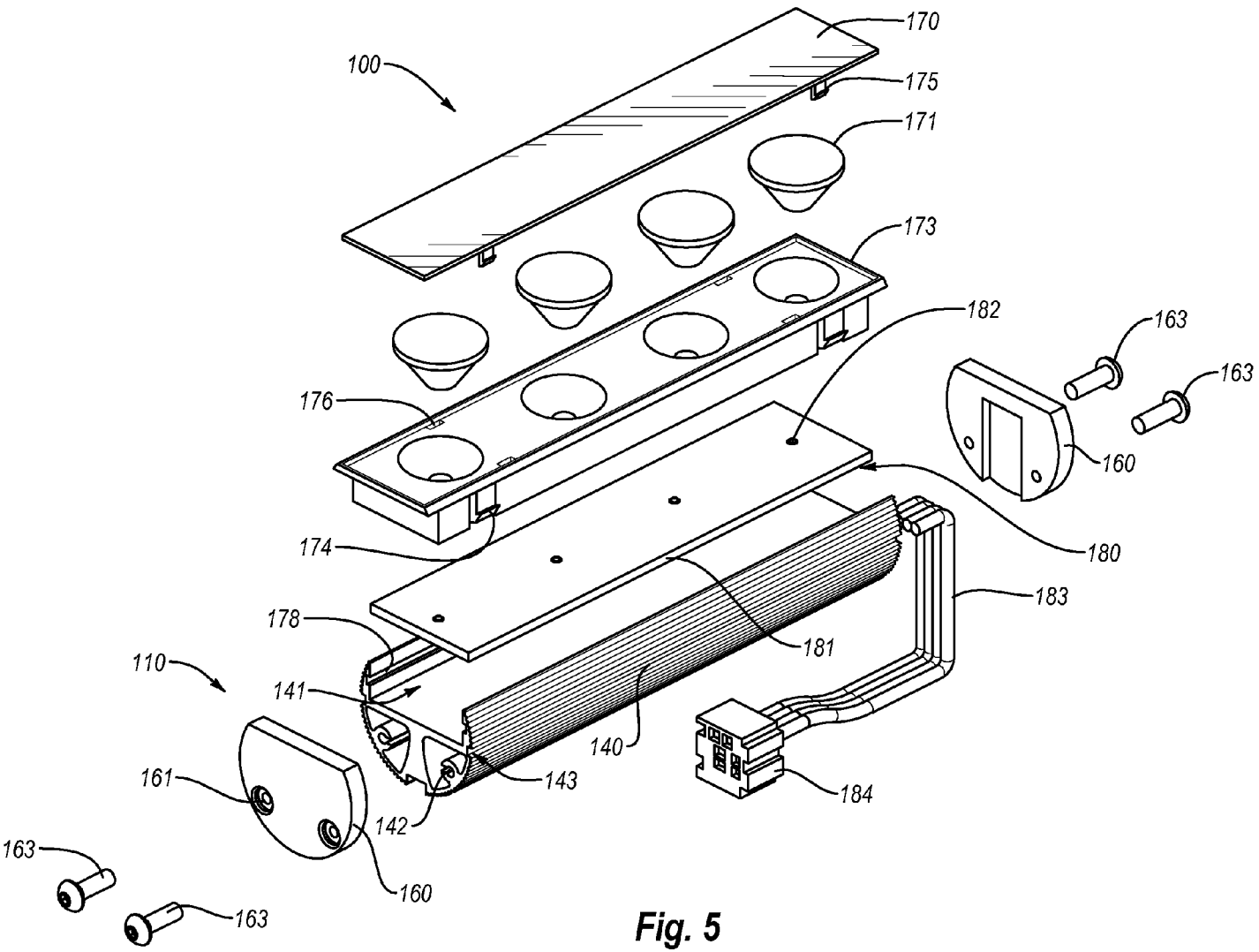
FIG. 5 illustrates an exploded view of a lighting fixture assembly in accordance with one or more implementations of the present invention.

Referring now to FIG. 5, an exploded view of the lighting fixture assembly 120 is illustrated. As shown, the body 140 can support one or more lighting components. For example, the body 140 can support a printed circuit board assembly 180 and/or lighting elements 182 (e.g., LED lights). The circuit board assembly 180 can provide the required functionality to control and/or operate the lighting elements 182. In alternative implementations, the body 140 can support halogen, fluorescent, or other lighting elements in place of LED lights.

The printed circuit board assembly 180 can include a cable 183, which can supply power as well as provide commands to the control board 181. The cable 183 can end in one or more connectors 184. For example, the cable 183 can end in a hermaphroditic connector 184. In at least one implementation, the hermaphroditic connector 184 can allow the installer to connect the circuit board assembly 180 to a power source and/or to a light controller. For instance, the light controller can set brightness of the lighting elements 182. Additionally, the light controller can signal which lighting elements 182 will be turned on (or lighted). Still further the light controller can incorporate a timer that may determine when to turn on or off the lighting elements 182.

The manufacturer can mount and secure the printed circuit board assembly 180 to the body 140. Hence, the body 140 can assist in dissipating the heat and thereby cooling one or more lighting elements 182. Such cooling can prevent early failure and extend the life of the lighting elements 182. Furthermore, the body 140 also can provide support for additional elements that a manufacturer may desire to incorporate into the lighting module 110 and/or the lighting fixture assembly 120.

The lighting fixture assembly 120 also can include one or more end caps 160. The end caps 160 can secure one or more elements within the lighting fixture assembly 120. Additionally, the end caps 160 can limit the travel or movement of the lighting fixture assembly 120 with respect to the support base 130, 130*a*. Furthermore, the end caps 160 can conceal one or more elements disposed on or within the lighting fixture assembly 120 and can also protect such elements from environment.

For instance, the body 140 can include one or more fastening channels 142. The installer or manufacturer can use the fastening channels 142 to secure the end caps 160 using, for example, screws 163 (or other fasteners) that can fit through one or more mounting holes 161 in the end caps 160 and screw into the fastening channels 142. In light of this disclosure, those skilled in the art should appreciate other mechanisms for fastening or securing the end caps 160 to the body 140. For example, in one or more implementations, the end caps 160 can have a snap-fit, friction fit, or interference fit with the body 140.

The body 140 also can incorporate a locating channel 141. In one or more implementations, the locating channel 141 can locate and/or secure (in part) the printed circuit board assembly 180. The locating channel 141 also can provide additional shielding to the potentially fragile printed circuit board assembly 180. Accordingly, shielding of the printed circuit board assembly 180 can extend life of thereof, by protecting the printed circuit board assembly 180 from natural elements.

The lighting fixture assembly 120 also can include one or more covers 170. The covers 170 can protect various elements and components of the lighting fixture assembly 120. For example, the covers 170 can protect the printed circuit board assembly 180 as well as the lighting elements 182 disposed thereon. Additionally, the covers 170 can focus or direct light generated by the lighting elements 182, as further described below. For instance, the covers 170 can have one or more lenses 171, which can focus or direct light produced by the one or more lighting elements 182.

In at least one implementation, the lighting fixture assembly 120 can include lighting elements 182 and/or lenses 171 that are equidistant from adjacent lighting elements 182 and/or lenses 171, respectively (as further described below). Thus, the lighting fixture assembly 120 can generate equidistant light beams and/or evenly distributed light patterns. Even distribution of light can have advantages when illuminating a background, surface, or an area, such that the entire illuminated object or area is clearly visible.

The lenses 171 can have various configurations. For example, the lenses 171 can have a cone angle of approximately 25°. In light of the disclosure herein, it should be appreciated that the lenses 171 can have other cone angles. Moreover, in at least one implementation, the cover 170 can have integrated lenses 171. Alternatively, the lenses 171 can have an insert-like configuration, which can couple or secure to the cover 170. Furthermore, the installer can secure the cover 170 to the body 140. Alternatively, in light of this disclosure, it should be appreciated that the covers 170 can secure or couple to other elements of the lighting fixture assembly 120.

FIG. 5 further illustrates that the lighting fixture assembly 120 can further include an optics holder 173. The optics holder 173 can couple to the body 140. For example, the optics holder 173 can include one or more flexible hooks 174 configured to snap (i.e., flex inward and then flex back outward) into corresponding grooves 178 in the body 140. In alternative implementations, optics holder 173 can have a friction fit, an interference fit, or use fasteners to couple with the body 140.

The optics holder 173 can support the lens 171 and position them over the lighting elements 182. As shown by FIG. 5, the optics holder 173 can further support the cover 170. In particular, the cover 170 can include one or more flexible hooks 175 configured to snap (i.e., flex inward and then flex back outward) into corresponding recesses 176 in the optics holder 173. In alternative implementations, cover 170 can have a friction fit, an interference fit, or use fasteners to couple with the optics holder 173.

One will appreciate in light of the disclosure herein that the lighting fixture assembly 120 also can have essentially limitless number of positions with respect to the support base 130, 130*a*. Accordingly, the installer can slide the lighting fixture assembly 120 along the longitudinal axis thereof, and position the lighting fixture assembly 120 such that a desired area or surface is illuminated by the lighting fixture assembly 120. More specifically, the installer can rotationally position the lighting fixture assembly 120 about the longitudinal axis thereof, such that one or more lighting elements 182 face in a desired direction.

Similarly, the installer can adjust the rotational position of each lighting module 110 independently of any other lighting module 110. Thus, the installer can rotate a first lighting module 110 to face in a first direction and a second lighting module 110 to face in a second direction. In at least one instance, the first direction can be substantially the same as the second directions. Alternatively, the first and second directions can be different.

In one or more implementations, the lighting fixture assembly 120 can be secured and/or coupled to more than one support base 130, 130*a*. For example, the lighting fixture assembly 120 can couple to two support bases 130, 130*a*. A first support base 130*a*, 130 can have a position at a different distance from a center point of the lighting fixture assembly 120 along the longitudinal axis than a position of a second support base 130*a*, 130.

Figure 6:
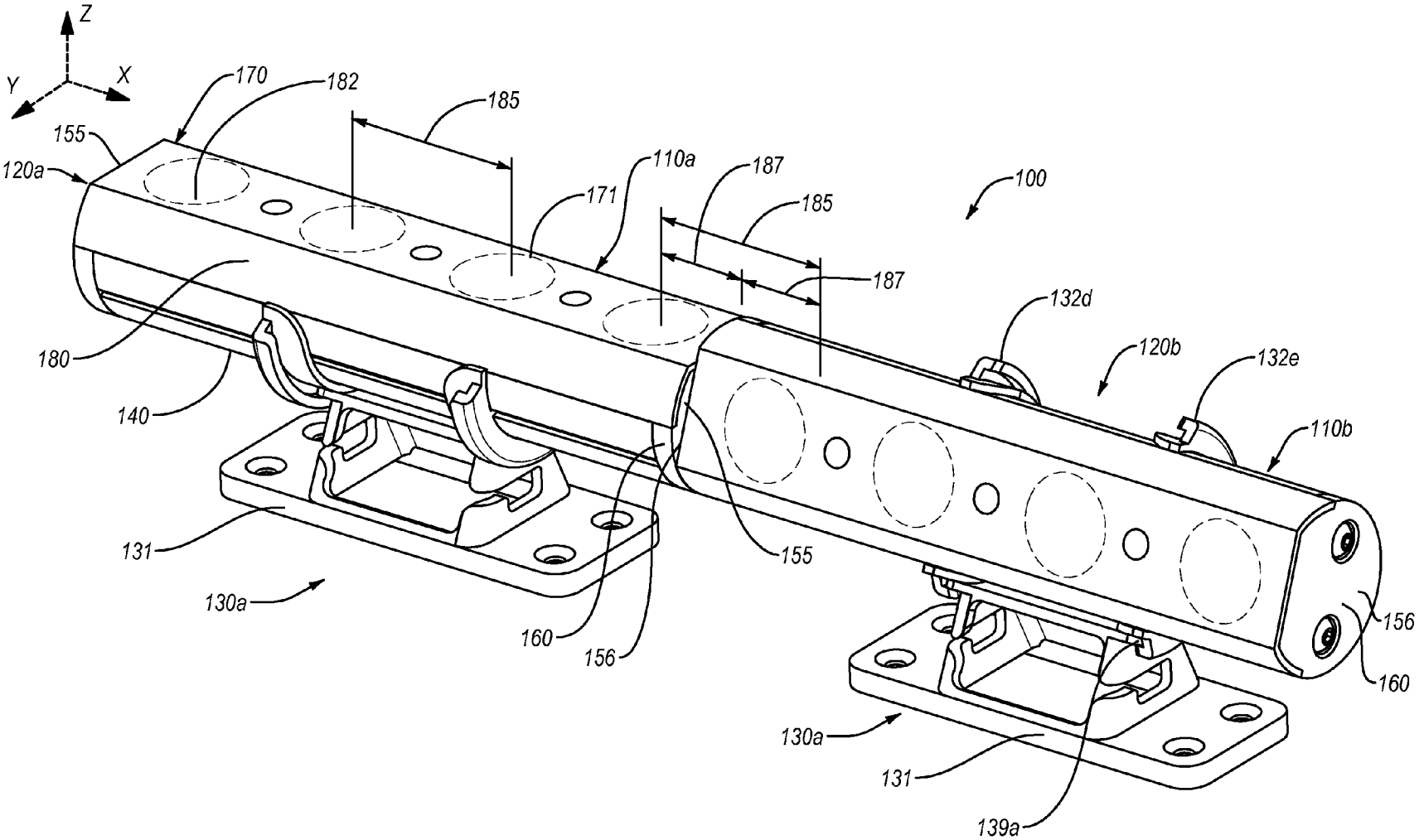
FIG. 6 illustrates a perspective view of a lighting system including a plurality of lighting modules in accordance with one or more implementations of the present invention.

Additionally, FIG. 6 illustrates an implementation of a lighting system 100 including multiple lighting modules 110*a*, 110*b*. The installer can choose various arrangements of the lighting modules 110*a*, 110*b* in creating or forming the lighting system 100. For instance, the installer can arrange the lighting modules 110*a*, 110*b* such that longitudinal axes of the lighting modules 110*a*, 110*b* are linearly aligned.

In at least one implementation, within the lighting system 100, each lighting fixture assembly 120*a* can have an independent longitudinal position with respect to any other lighting fixture assembly 120*b*. For example, the lighting fixture assembly 120*a* of the first lighting module 110*a* can abut the lighting fixture assembly 120*b* of the second lighting module 110*b*. Alternatively, the installer can space the lighting fixture assembly 120*a* of the first lighting module 110*a* apart from the lighting fixture assembly 120*b* of the second lighting module 110*b*.

Moreover, the position of one or more support bases 130*a* securing a first lighting fixture assembly 120*a* can be independent of the position of the support bases 130*a* securing a second lighting fixture assembly 120*b*. For instance, the installer can position the support base 130*a* securing the first lighting fixture assembly 120*a* proximate to a first edge of the first lighting fixture assembly 120*a*. By contrast, the installer can position the support base 130*a* securing the second lighting fixture assembly 120*b* proximate to a center point of the second lighting fixture assembly 120*b*.

As described above, the lighting system 100 can have multiple lighting modules 110*a*, 110*b* that generate equidistant light beams. In at least one implementation, the lighting elements of a first lighting module 110*a* can have substantially the same spacing as the lighting elements of an adjacent second lighting module 110*b*.

For example, each lighting element of the first lighting fixture assembly 120*a* be spaced a first distance 185 from any adjacent lighting elements of the first lighting fixture assembly 120*a*. Similarly, each lighting element of the second lighting fixture assembly 120*b* be spaced a first distance 185 from any adjacent lighting elements of the second lighting fixture assembly 120*b*. The equal spacing of the lighting elements of each lighting fixture assembly can allow for even distribution of light.

Furthermore, each lighting element of the first lighting fixture assembly 120*a* closest to each end 185, 186 of the first lighting fixture assembly 120*a* can be spaced a second distance 187 from the respective end 185, 186 of the first lighting fixture assembly 120*a*. Similarly, each lighting element of the second lighting fixture assembly 120*b* closest to each end 185, 186 of the second lighting fixture assembly 120*b* can be spaced the second distance 187 from the respective end 185, 186 of the second lighting fixture assembly 120*b*. Thus, when the first and second lighting fixture assemblies 120*a*, 120*b* are abutted against each other, the lighting element of the second lighting fixture assembly 120*b* closest to the first end 155 of the second lighting fixture assembly 120*b* is spaced the first distance 185 from the lighting element of the first lighting fixture assembly 120*a* closest to the second end 186 of the first lighting fixture assembly 120*a*.

Figure 7:
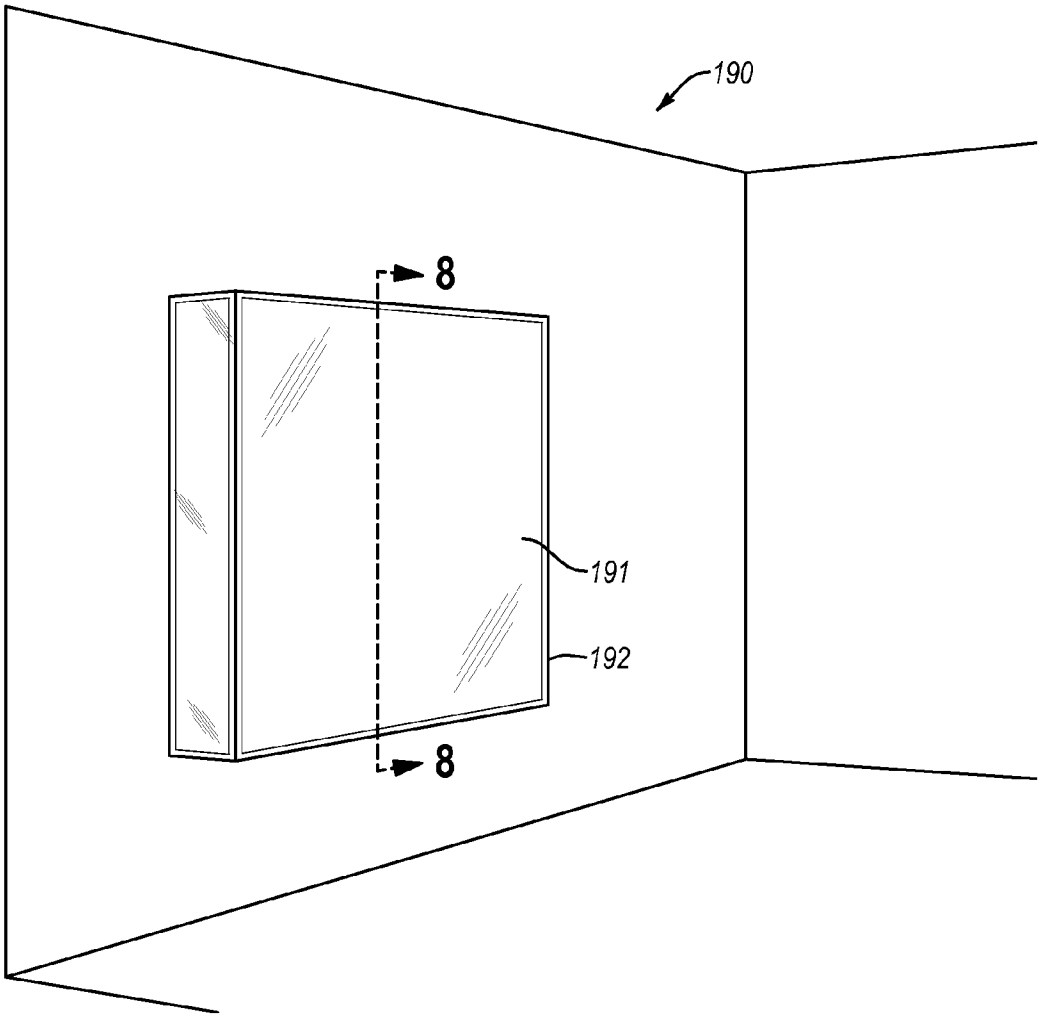
FIG. 7 illustrates a perspective view of a light box in accordance with one or more implementations of the present invention.

As illustrated in FIG. 7, at least one implementation can include a uniformly illuminated light box 190. Such light box can have one or more panels 191 secured to a frame 192. The panels 191 can have a color or texture and translucent properties as more fully described in U.S. patent application Ser. No. 13/262,206, filed on Oct. 11, 2011, entitled "Light Boxes with Uniform Light Distribution," the entire content of which is incorporated by reference herein.

Figures 8A, 8B:
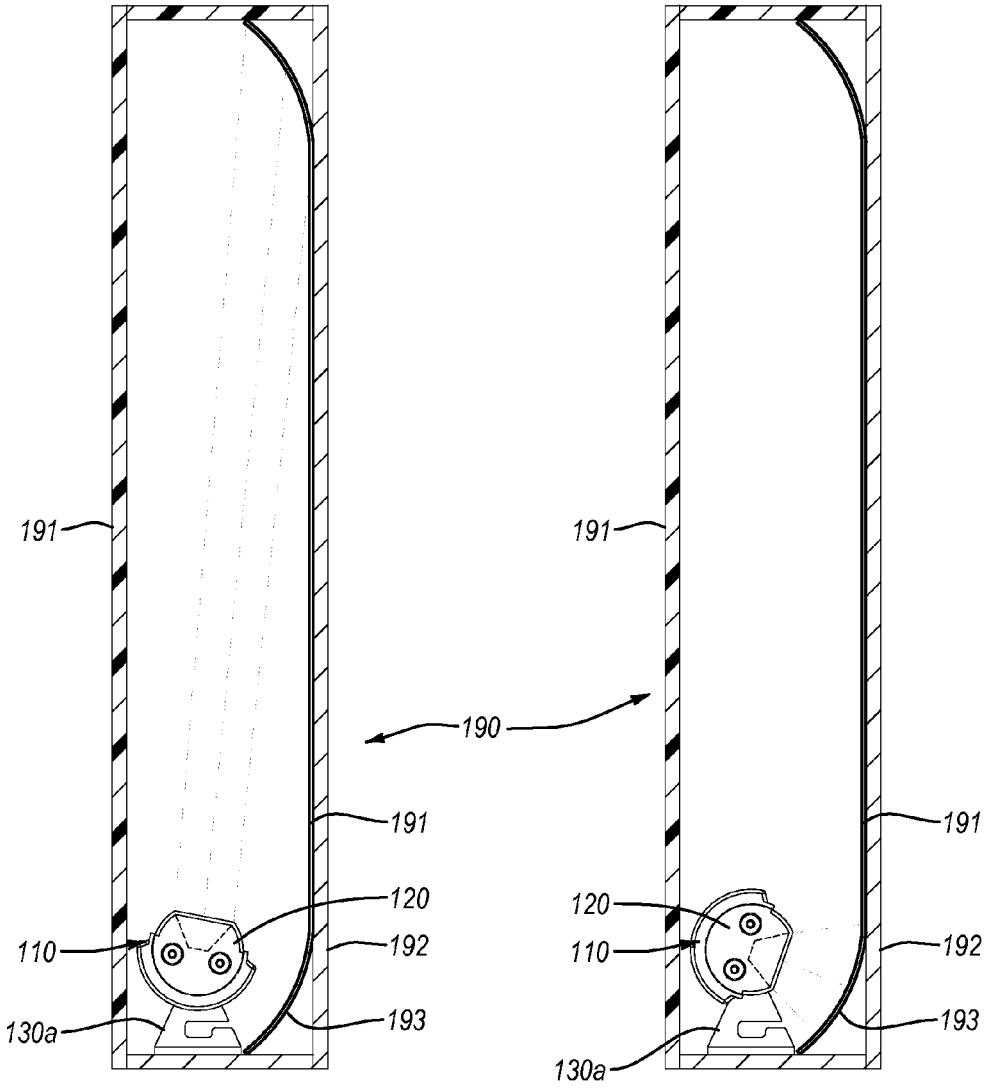
FIG. 8A illustrates a cross-sectional view of the light box of FIG. 7 taken along the line 8-8 of FIG. 7 that shows a lighting module pointing upward.
FIG. 8B illustrates a cross-sectional view of the light box of FIG. 7 taken along the ling 8-8 of FIG. 7 that shows a lighting module pointing downward.

The light box 190 also can have one or more lighting modules 110, as illustrated in FIGS. 8A and 8B. The lighting modules 110 can illuminate the panels 191, either directly or indirectly. For instance, the lighting modules 110 can rotate to face a reflector 193, and the reflector can projected the light onto one or more panels 191. Alternatively, the lighting modules 110 can project light directly onto one or more panels 191.

In at least one implementation, the reflector 193 can cover one or more entire panels 191 and can have one or more arcuate surfaces. The reflector 193 also can have a surface capable of reflecting light therefrom. For example, the reflector 193 can have a substantially white surface. Alternatively, the reflector 193 can have a mirror-like surface, such as that of a polished metal. The installer can choose the type of the reflective surface based on the particular requirements and the amount of light desired on the panel 191.

Furthermore, as described above, the lighting modules 110 can face the reflector 193. For example, the lighting module 110 can point substantially toward a portion of the reflector 193 that is opposite to the location of the lighting module 110, as illustrated in FIG. 8A. Alternatively, the lighting module 110 can point toward a portion of the reflector 193 that is closest to the lighting module 110, as illustrated in FIG. 8B.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A lighting module, comprising:

at least one support base comprising: (i) opposing rails having opposing first and second slide protrusions extending therefrom, wherein at least one of the opposing rails is a flexible rail that can be flexed in and out of position, and (ii) at least a third slide protrusion on a fixed or inflexible portion of the support base; and a lighting fixture assembly, comprising:

a body having a length and a plurality of mounting grooves along the length of the body, the each mounting groove being configured to correspondingly receive one of the first, second, or third slide protrusions therein to thereby guide and secure the body about each slide protrusion; and one or more lighting elements; and wherein the lighting fixture assembly is movably securable to the at least one support base such that once secured to the at least one support base, the lighting fixture assembly can be selectively translated along the first, second, and third slide protrusions of the opposing rails.

2. The lighting module as recited in claim 1, wherein the at least one flexible rail is configured such that when the body is pushed against the opposing rails, the at least one flexible rail outward thereby allowing at least the first and second slide protrusions in the rails to snap into the corresponding mounting grooves in the body, while the third slide protrusion rests in a lower mounting groove of the body.

3. The lighting module as recited in claim 2, wherein the lighting fixture assembly is configured to be selectively rotated relative to a base plate coupled to the at least one support base.

4. The lighting module as recited in claim 3, wherein:

the one or more rails are curved; and the base plate comprises one or more tabs sized and configured to slide within the one or more curved rails.

5. The lighting module as recited in claim 1, wherein the lighting fixture assembly further comprises an end cap on each end of the body, the end caps being configured to limit the translational movement of the lighting fixture assembly relative to the support base.

6. The lighting module as recited in claim 1, further comprising one or more covers comprising one or more lenses.

7. The lighting module as recited in claim 1, wherein the one or more lighting elements comprise a plurality of lighting elements equally spaced along the length of the body.

8. A lighting system, comprising:

a first lighting fixture assembly having a first end, an opposing second end, and a first plurality of lighting elements positioned between the first and second ends, the first lighting fixture further comprising three or more slide protrusions, with at least two slide protrusions extending from opposing rails, wherein:

each lighting element of the first plurality of lighting elements is spaced a first distance from adjacent lighting elements of the first plurality of lighting elements, a lighting element of the first plurality of lighting elements closest to the first end is spaced one half of the first distance from the first end of the first lighting fixture assembly, and a lighting element of the first plurality of lighting elements closest to the second end is spaced one half of the first distance from the second end of the first lighting fixture assembly;

a first support base configured to be secured to a support surface;

wherein at least one of the three slide protrusions on the rails can be flexed inward and outward to receive the light fixture assembly, and wherein another of the three slide protrusions extends from a fixed position that neither flexes inward nor outward;

wherein the first lighting fixture assembly is rotatably and slidably securable to the first support base such that once secured to the first support base, the first lighting fixture assembly can be selectively translated along the three or more slide protrusions, and rotated relative to the first support base.

9. The lighting system as recited in claim 8, further comprising:

a second lighting fixture assembly having a first end, an opposing second end, and a second plurality of lighting elements positioned between the first and second ends thereof, wherein:

the first end of the second lighting fixture abuts the second end of the first lighting fixture; and a lighting element of the second plurality of lighting elements closet to the first end of the second lighting fixture is spaced the first distance from the lighting element of the first plurality of lighting elements closest to the second end of the first lighting fixture assembly.

10. The lighting system as recited in claim 9, further comprising:

a second support base configured to be secured to the support surface;

wherein the second lighting fixture assembly is rotatably and movably securable to the second support base such that once secured to the second support base, the second lighting fixture assembly can be selectively translated and rotated relative to the second support base.

11. The lighting system as recited in claim 10, wherein the first and second lighting assemblies are separately orientable relative to the support surface.

12. The lighting system as recited in claim 10, wherein the first lighting fixture assembly comprises:

a body; and one or more mounting channels extending along the body.

13. The lighting system as recited in claim 8, wherein the first support base comprises:

a base plate comprises opposing tabs; and a pair of curved rails of the first support base are slidably coupled to the opposing tabs;

wherein movement of the pair of curved rails relative to the opposing tabs rotates the first lighting fixture assembly relative to the support surface.

14. A uniformly illuminated light box with sliding and rotatable lighting modules, which substantially eliminate hot spots, shadows, scalloping, or other non-uniform light distribution with respect to one or more surfaces of the light box, comprising:

a frame;

one or more translucent panels secured to the frame; and one or more lighting modules, each lighting module of the one or more lighting modules comprising:

a support base secured to the frame, the support base comprising:

a base plate that is connectable to the frame; and opposing rails rotationally coupled to the base plate; and a lighting fixture assembly selectively securable to the support base, the lighting fixture assembly being configured to be snapped into the opposing rails via corresponding grooves in the lighting fixture assembly, such that the opposing rails secure corresponding grooves of the lighting fixture assembly, the lighting fixture assembly being slidably coupled to the support base via at least one slide protrusion at a bottom portion of the support base, such that the lighting fixture assembly can be selectively positioned relative to the support base and to the one or more translucent panels.

15. The uniformly illuminated light box as recited in claim 14, further comprising a back plate with a reflective surface mounted to the frame opposite one of the one or more translucent panels.

16. The uniformly illuminated light box as recited in claim 15, wherein the lighting fixture assembly is rotatably coupled to the support base.

17. The uniformly illuminated light box as recited in claim 16, wherein at least one of the one or more lighting modules is rotated to project light on the reflective surface of the back plate.

18. The uniformly illuminated light box as recited in claim 14, wherein at least one of the one or more translucent panels includes a diffusion layer on an inner surface thereof.

* * * * *

UNITED STATES PATENT AND TRADEMARK OFFICE

CERTIFICATE OF CORRECTION

PATENT NO. : 8,926,126 B2
APPLICATION NO. : 13/447681
DATED : January 6, 2015
INVENTOR(S) : Ronen et al.

It is certified that error appears in the above-identified patent and that said Letters Patent is hereby corrected as shown below:

Specification

Column 4
Line 25, change "functionally" to --functionality--
Line 48, change "indicted" to --indicated--

Column 5
Line 64, change "or" to --of--
Line 63, change "adjust" to --adjusting--

Column 6
Line 60, change "13a" to --132a-c--

Column 10
Line 60, change "185,186" to --155, 156--
Line 62, change "185,186" to --155, 156--
Line 65, change "185,186" to --155, 156--
Line 66-67, change "185,186" to --155, 156--

Column 11
Line 6, change "186" to --156--

Signed and Sealed this
Twenty-ninth Day of December, 2015

Michelle K. Lee

Michelle K. Lee
*Director of the United States Patent and Trademark Office*